US010858924B2

(12) United States Patent
Saponja et al.

(10) Patent No.: US 10,858,924 B2
(45) Date of Patent: Dec. 8, 2020

(54) SYSTEMS FOR IMPROVING DOWNHOLE SEPARATION OF GASES FROM LIQUIDS WHILE PRODUCING RESERVOIR FLUID

(71) Applicant: Heal Systems LP, Calgary (CA)

(72) Inventors: Jeff Saponja, Calgary (CA); Rob Hari, Calgary (CA); Dave Kimery, Calgary (CA); Trystan Wall, Calgary (CA); Tim Keith, Calgary (CA)

(73) Assignee: HEAL SYSTEMS LP, Calgary (CA)

( * ) Notice: Subject to any disclaimer, the term of this patent is extended or adjusted under 35 U.S.C. 154(b) by 72 days.

(21) Appl. No.: 16/209,572

(22) Filed: Dec. 4, 2018

(65) Prior Publication Data

US 2019/0376378 A1 Dec. 12, 2019

Related U.S. Application Data

(60) Provisional application No. 62/594,285, filed on Dec. 4, 2017.

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01); *E21B 43/127* (2013.01)

(58) Field of Classification Search
CPC ..... E21B 43/38; E21B 43/121; E21B 43/127; E21B 43/128
See application file for complete search history.

(56) References Cited

U.S. PATENT DOCUMENTS

| | | | | |
|---|---|---|---|---|
| 1,554,835 | A * | 9/1925 | Barrett | E21B 43/38 166/105.5 |
| 9,518,458 | B2 | 12/2016 | Ellithorp et al. | |
| 9,909,400 | B2 | 3/2018 | Ellithorp et al. | |
| 2015/0075772 | A1* | 3/2015 | Saponja | E21B 43/121 166/115 |
| 2018/0187531 | A1 | 7/2018 | Ellithorp et al. | |
| 2019/0055809 | A1 | 2/2019 | Ellithorp | |

* cited by examiner

*Primary Examiner* — David Carroll
(74) *Attorney, Agent, or Firm* — Michael Dae

(57) ABSTRACT

A reservoir fluid production system for producing reservoir fluid from a subterranean formation is provided for mitigating gas interference by effecting downhole separation of a gaseous phase from reservoir fluids, while mitigating entrainment of liquid hydrocarbon material within the gaseous phase.

20 Claims, 7 Drawing Sheets

SYSTEMS FOR IMPROVING DOWNHOLE SEPARATION OF GASES FROM LIQUIDS WHILE PRODUCING RESERVOIR FLUID

CROSS-REFERENCE TO RELATED APPLICATIONS

This application claims priority from U.S. Provisional Application No. 62/594,285, filed on Dec. 4, 2017. The entire contents of this priority application is incorporated herein by reference.

FIELD

The present disclosure relates to mitigating downhole pump gas interference during hydrocarbon production

BACKGROUND

Downhole pump gas interference is a problem encountered while producing wells, especially wells with horizontal sections. In producing reservoir fluids containing a significant fraction of gaseous material, the presence of such gaseous material hinders production by contributing to sluggish flow.

SUMMARY

In one aspect, there is provided a reservoir fluid production system for producing reservoir fluid from a subterranean formation, comprising:

a wellbore including an uphole portion and a downhole portion;

a wellbore string that is lining the wellbore;

wherein:

the wellbore string includes a wider intermediate section and an uphole-disposed section that is disposed uphole relative to the wider intermediate section;

the uphole-disposed section includes a narrower uphole-disposed section; and the wider intermediate section is wider relative to the narrower uphole-disposed section; and a reservoir fluid production assembly disposed within wellbore string such that an intermediate wellbore passage is defined within a space between the wellbore string and the assembly and is extending longitudinally through the wellbore, wherein the assembly includes wherein:

the wellbore string and the reservoir fluid production assembly are co-operatively configured such that, while the wellbore string is receiving reservoir fluid from the subterranean formation, the reservoir fluid is conducted uphole to the reservoir fluid separation space, with effect that a gas-depleted reservoir fluid is separated from the reservoir fluid within the reservoir fluid separation space and conducted through the reservoir fluid production assembly to the surface; and at least a portion of the reservoir fluid separation space defines a separation-facilitating passage portion of the intermediate wellbore passage, and the separation-facilitating passage portion is disposed within the wider intermediate section.

In another aspect, there is provided a reservoir fluid production system for producing reservoir fluid from a subterranean formation, comprising:

a wellbore including an uphole portion and a downhole portion;

a wellbore string that is lining the wellbore;

wherein:

the wellbore string includes a wider intermediate section and an uphole-disposed section that is disposed uphole relative to the wider intermediate section;

the uphole-disposed section includes a narrower uphole-disposed section; and the wider intermediate section is wider relative to the narrower uphole-disposed section;

a reservoir fluid production assembly disposed within wellbore string such that an intermediate wellbore passage is defined within a space between the wellbore string and the assembly and is extending longitudinally through the wellbore, wherein the assembly includes a flow diverter body including a reservoir fluid receiver, a reservoir fluid discharge communicator, and a gas-depleted reservoir fluid receiver;

and a sealed interface;

wherein:

the sealed interface prevents, or substantially prevents, flow communication, via the intermediate wellbore passage, between the downhole wellbore space and the uphole wellbore space;

the wellbore string, the assembly, and the sealed interface are co-operatively configured such that, while the flow diverter body is receiving reservoir fluid, via the reservoir fluid receiver, from the subterranean formation via the downhole wellbore space, and discharging the received reservoir fluid, via the reservoir fluid discharge communicator, into the uphole wellbore space, within a reservoir fluid separation space of the uphole wellbore space, a gas-depleted reservoir fluid is separated from the discharged reservoir fluid, in response to at least buoyancy forces, and is conducted to the gas-depleted reservoir fluid receiver; and at least a portion of the reservoir fluid separation space defines a separation-facilitating passage portion of the intermediate wellbore passage, and the separation-facilitating passage portion is disposed within the wider intermediate section.

BRIEF DESCRIPTION OF DRAWINGS

The preferred embodiments will now be described with reference to the following accompanying drawings.

DETAILED DESCRIPTION

Figure 1:
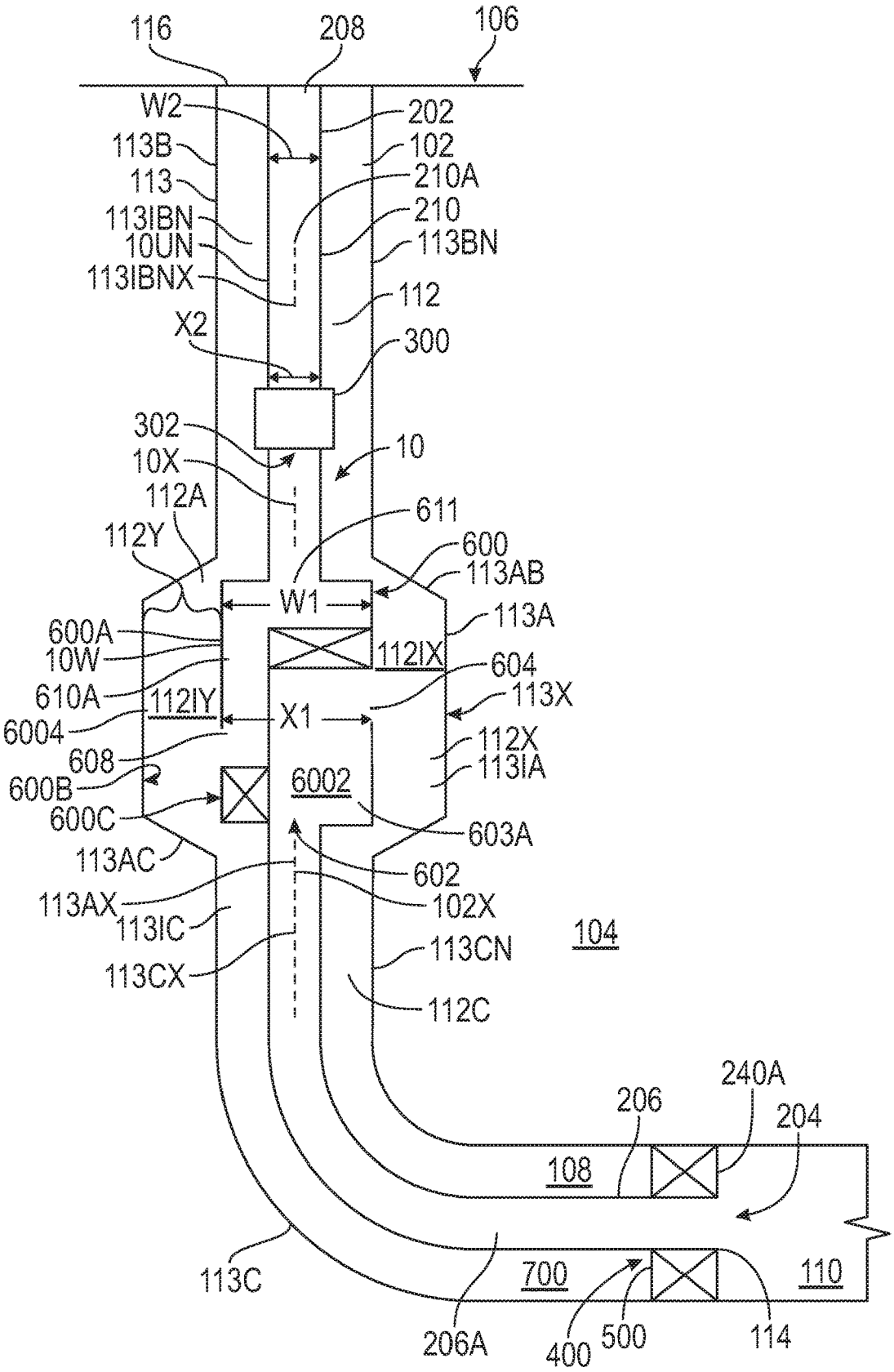
FIG. 1 is a schematic illustration of an embodiment of a system including a reservoir fluid production assembly disposed within a wellbore.

As used herein, the terms "up", "upward", "upper", or "uphole", mean, relativistically, in closer proximity to the surface 106 and further away from the bottom of the wellbore, when measured along the longitudinal axis of the wellbore 102. The terms "down", "downward", "lower", or "downhole" mean, relativistically, further away from the surface 106 and in closer proximity to the bottom of the wellbore 102, when measured along the longitudinal axis of the wellbore 102.

Referring to FIGS. 1 to 6, there are provided systems 8, with associated apparatuses, for producing hydrocarbons from a reservoir, such as an oil reservoir, within a subterranean formation 100, when reservoir pressure within the oil reservoir is insufficient to conduct hydrocarbons to the surface 106 through a wellbore 102.

The wellbore 102 can be straight, curved, or branched. The wellbore 102 can have various wellbore portions. A wellbore portion is an axial length of a wellbore 102. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between 70 and 110 degrees from vertical.

"Reservoir fluid" is fluid that is contained within an oil reservoir. Reservoir fluid may be liquid material, gaseous material, or a mixture of liquid material and gaseous material. In some embodiments, for example, the reservoir fluid includes water and hydrocarbons, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

A wellbore string 113 is employed within the wellbore 102 for stabilizing the subterranean formation 100. In some embodiments, for example, the wellbore string 113 also contributes to effecting fluidic isolation of one zone within the subterranean formation from another zone within the subterranean formation.

The fluid productive portion of the wellbore 102 may be completed either as a cased-hole completion or an open-hole completion.

A cased-hole completion involves running wellbore casing down into the wellbore through the production zone. In this respect, in the cased-hole completion, the wellbore string 113 includes wellbore casing.

The annular region between the deployed wellbore casing and the oil reservoir may be filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of flow communication between one or more zones of the oil reservoir and one or more others zones of the oil reservoir (for example, such as a zone that is being produced). By effecting the sealing, or substantial sealing, of such flow communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the production casing and the oil reservoir.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore casing and the oil reservoir after the subject wellbore casing has been run into the wellbore. This operation is known as "cementing".

In some embodiments, for example, the wellbore casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface 106. Typically, casing string sizes are intentionally minimized to minimize costs during well construction. Generally, smaller casing sizes make production and artificial lofting more challenging.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 116. In some embodiments, for example. the annular region between the last casing string and the production tubing string may be sealed at the bottom by a packer.

To facilitate flow communication between the reservoir and the wellbore, the wellbore casing may be perforated, or otherwise include per-existing ports (which may be selectively openable, such as, for example, by shifting a sleeve), to provide a fluid passage for enabling flow of reservoir fluid from the reservoir to the wellbore.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 116. Cement may be provided within the annular region between the liner string and the oil reservoir for effecting zonal isolation (see below), but is not in all cases. In some embodiments, for example, this liner is perforated to effect flow communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead 116. In some embodiments, for example, no cemented liner is installed, and this is called an open hole completion or uncemented casing completion.

An open-hole completion is effected by drilling down to the top of the producing formation, and then lining the wellbore (such as, for example, with a wellbore string 113). The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as standalone screens, open hole gravel packs and open hole expandable screens. Packers and casing can segment the open hole into separate intervals and ported subs can be used to effect flow communication between the reservoir and the wellbore.

Figure 2:
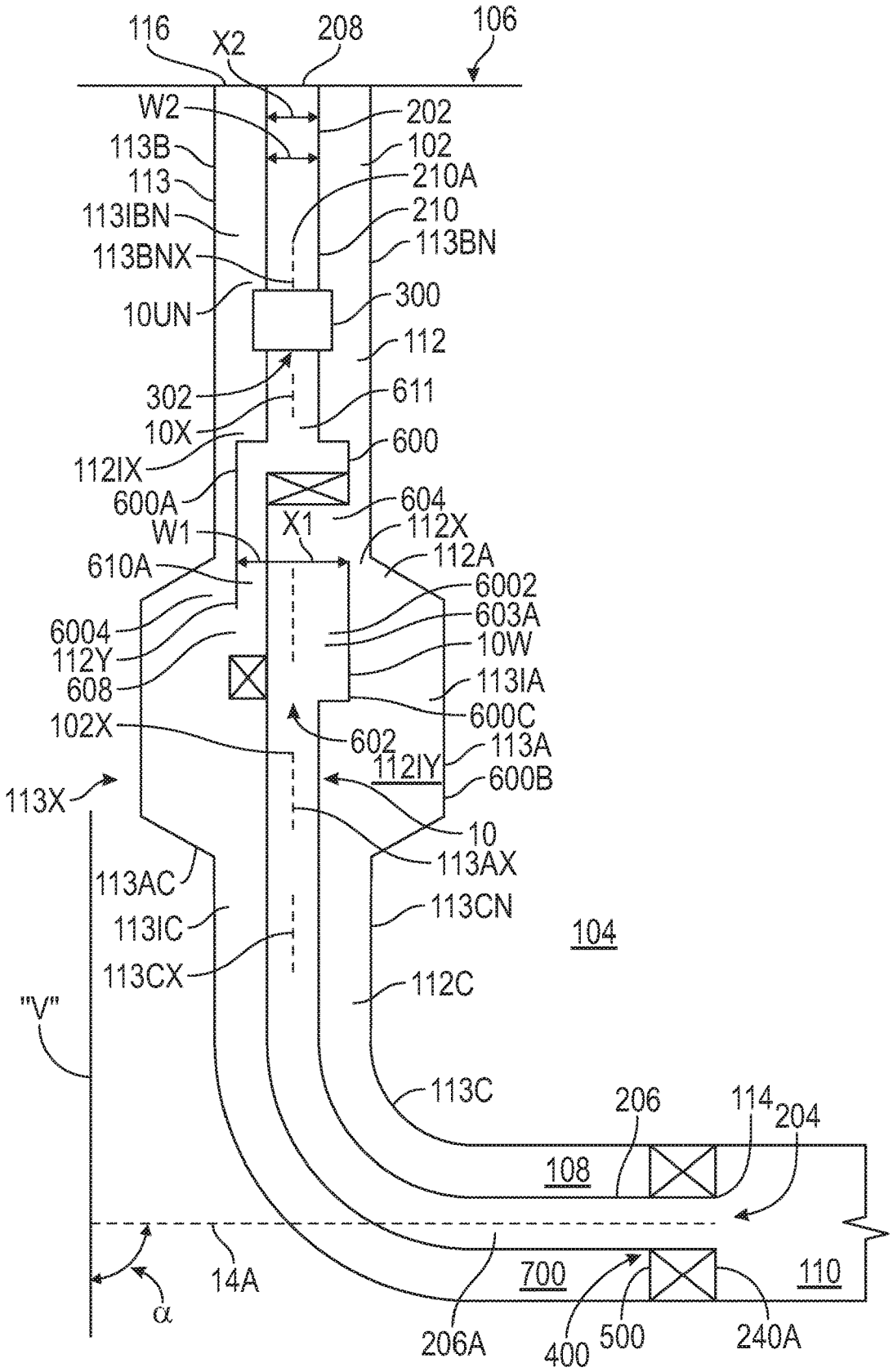
FIG. 2 is a schematic illustration of another embodiment of a system including a reservoir fluid production assembly disposed within a wellbore.
Figure 3:
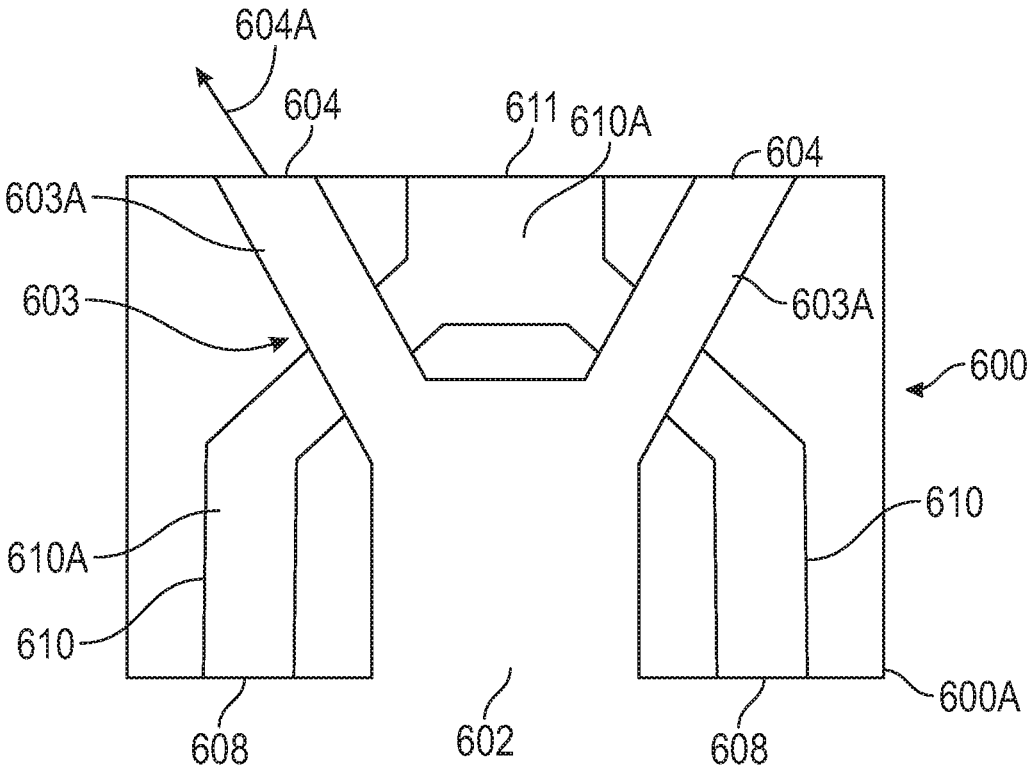
FIG. 3 is a schematic illustration of an embodiment of a flow diverter of embodiments of the system of the present disclosure.

Referring to FIGS. 1 to 3, an assembly 10 is provided for effecting production of reservoir fluid from the reservoir 104.

In some embodiments, for example, a wellbore fluid conductor 113, such as, for example, the wellbore string 113 (such as, for example, the casing 113), is disposed within the wellbore 102. The assembly 10 is configured for disposition within the wellbore fluid conductor 113, such that an intermediate wellbore passage 112 is defined within the wellbore fluid conductor 113, between the assembly 10 and the wellbore fluid conductor 113. In some embodiments, for example, the intermediate wellbore passage 112 is an annular space disposed between the assembly 10 and the wellbore string 113. In some embodiments, for example, the intermediate wellbore passage 112 is defined by the space that extends outwardly, relative to the central longitudinal axis of the assembly 10, from the assembly 10 to the wellbore fluid conductor 113. In some embodiments, for example, the intermediate wellbore passage 112 extends longitudinally to the wellhead 116, between the assembly 10 and the wellbore string 113.

The assembly 10 includes a production string 202 that is disposed within the wellbore 102. The production string 202 includes a pump 300

The pump 300 is provided to, through mechanical action, pressurize and effect conduction of the reservoir fluid from the reservoir 104, through the wellbore 102, and to the surface 106, and thereby effect production of the reservoir fluid. It is understood that the reservoir fluid being conducted uphole through the wellbore 102, via the production string 202, may be additionally energized by supplemental means, including by gas-lift. In some embodiments, for example, the pump 300 is a sucker rod pump. Other suitable pumps 300 include screw pumps, electrical submersible pumps, and jet pumps.

The system also includes a flow diverter 600. The flow diverter 600 is provided for, amongst other things, mitigating gas lock within the pump 300.

In some embodiments, the flow diverter 600 includes a wellbore string counterpart 600B and an assembly counterpart 600C. The wellbore string 113 defines the wellbore string counterpart 600B, and the assembly 10 defines the assembly counterpart 600C. The flow diverter 600 defines: (i) a reservoir fluid-conducting passage 6002 for conducting reservoir fluid to a reservoir fluid separation space 112X of the wellbore 102, with effect that a gas-depleted reservoir fluid is separated from the reservoir fluid within the reservoir fluid separation space 112X in response to at least buoyancy forces; and (ii) a gas-depleted reservoir fluid-conducting passage 6004 for receiving the separated gas-depleted reservoir fluid while the separated gas-depleted reservoir fluid is flowing in a downhole direction, and diverting the flow of the received gas-depleted reservoir fluid such that the received gas-depleted reservoir fluid is conducted by the flow diverter 600 in the uphole direction to the pump 300.

As discussed above, the wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the reservoir 104. When disposed in flow communication with the reservoir 104, the wellbore 102 is disposed for receiving reservoir fluid flow from the reservoir 104.

The production string inlet 204 is for receiving, via the wellbore, the reservoir fluid flow from the reservoir. In this respect, the reservoir fluid flow enters the wellbore 102, as described above, and is then conducted to the production string inlet 204. The production string 202 includes a downhole fluid conductor 206, disposed downhole relative to the flow diverter 600 for conducting the reservoir fluid flow, that is being received by the production string inlet, such that the reservoir fluid flow, that is received by the inlet 204, is conducted to the flow diverter 600 via the downhole fluid conductor 206. The production string 202 also includes an uphole fluid conductor 210, disposed uphole relative to the flow diverter 600 for conducting a gas-depleted reservoir fluid flow (see below) from the flow diverter 600 to a production string outlet 208, located at the wellhead 116.

It is preferable to remove at least a fraction of the gaseous material from the reservoir fluid flow being conducted within the production string 202, prior to the pump suction 302, in order to mitigate gas interference or gas lock conditions during pump operation. The flow diverter 600, is provided to, amongst other things, perform this function. In this respect, the flow diverter 600 is disposed downhole relative to the pump 300 and is fluidly coupled to the pump suction 302, such as, for example, by an intermediate fluid conductor that forms part of the uphole fluid conductor 210, such as piping. Suitable exemplary flow diverters are described in International Application No. PCT/CA2015/000178, published on Oct. 1, 2015.

In some embodiments, for example, the assembly counterpart 600C includes a fluid diverter body 600A.

Referring to FIGS. 1 to 6, in some embodiments, for example, the flow diverter body 600A is configured such that the depletion of gaseous material from the reservoir fluid material, that is effected while the assembly 10 is disposed within the wellbore 102, is effected externally of the flow diverter body 600A within the wellbore 102, such as, for example, within an uphole wellbore space 108 of the wellbore 102.

The flow diverter body 600A includes a reservoir fluid receiver 602 for receiving the reservoir fluid (such as, for example, in the form of a reservoir fluid flow) that is being conducted (e.g. flowed), via the downhole fluid conductor 206 of the production string 202, from the production string inlet 204. In some embodiments, for example, the downhole fluid conductor 206 extends from the inlet 204 to the receiver 602. In this respect, the downhole fluid conductor 206 is fluidly coupled to the inlet 204.

Referring specifically to FIG. 3, the flow diverter body 600A also includes a reservoir fluid discharge communicator 604 that is fluidly coupled to the reservoir fluid receiver 602 via a reservoir fluid-conductor 603. In this respect, the reservoir fluid conductor 603 defines at least a portion of the reservoir fluid-conducting passage 6002.

The reservoir fluid conductor 603 defines one or more reservoir fluid conductor passages 603A. In some of the embodiments described below, for example, the one or more reservoir fluid-conducting passages 603A. The reservoir fluid discharge communicator 604 is configured for discharging reservoir fluid (such as, for example, in the form of a flow) that is received by the reservoir fluid receiver 602 and conducted to the reservoir fluid discharge communicator 604 via the reservoir fluid conductor 603. In some embodiments, for example, the reservoir fluid discharge communicator 604 is disposed at an opposite end of the flow diverter body 600A relative to the reservoir fluid receiver 602.

The flow diverter body 600A also includes a gas-depleted reservoir fluid receiver 608 for receiving a gas-depleted reservoir fluid (such as, for example, in the form of a flow), after gaseous material has been separated from the reservoir fluid (for example, a reservoir fluid flow), that has been discharged from the reservoir fluid discharge communicator 604, in response to at least buoyancy forces. In this respect, the gas-depleted reservoir fluid receiver 608 and the reservoir fluid discharge communicator 604 are co-operatively configured such that the gas-depleted reservoir fluid receiver 608 is disposed for receiving a gas-depleted reservoir fluid flow, after gaseous material has been separated from the received reservoir fluid flow that has been discharged from the reservoir fluid discharge communicator 604, in response to at least buoyancy forces. In some embodiments, for example, the reservoir fluid discharge communicator 604 is disposed at an opposite end of the flow diverter body 600A relative to the gas-depleted reservoir fluid receiver 608.

The flow diverter body 600A also includes a gas-depleted reservoir fluid conductor 610 that defines a gas-depleted reservoir fluid-conducting passage 610A configured for conducting the gas-depleted reservoir fluid (for example, a gas-depleted reservoir fluid flow), received by the receiver 608, to the gas-depleted reservoir fluid discharge communicator 604. In some embodiments, for example, the gas-depleted reservoir fluid discharge communicator 611 is disposed at an opposite end of the flow diverter body 600A relative to the gas-depleted reservoir fluid receiver 608. The gas-depleted reservoir fluid discharge communicator 611 is configured for fluid coupling to the pump 300, wherein the fluid coupling is for supplying the pump 300 with the gas-depleted reservoir fluid received by the receiver 610 and conducted through at least the gas-depleted reservoir fluid conductor 610. In this respect, the gas-depleted reservoir fluid-conducting passage 610A defines at least a portion of the gas-depleted reservoir fluid-conducting passage 6004.

In some embodiments, for example, the flow diverter body 600A includes the reservoir fluid receiver 602 (such as, for example, in the form of one or more ports), the reservoir fluid discharge communicator 604 (such as, for example, in the form of one or more ports), and the reservoir fluid-conductor 603 (such as, for example, in the form of one or more fluid passages 603A, such as, for example, a network of fluid) for fluidly coupling the receiver 602 and the discharge communicator 604. The flow diverter body 600A also includes the gas-depleted reservoir fluid receiver 608 (such as, for example, in the form of one or more ports), gas-depleted reservoir fluid discharge communicator 611 (such as, for example, in the form of one or more ports), and the gas-depleted reservoir fluid conductor 610 (such as, for example, in the form of a fluid passage or a network of fluid passages) for fluidly coupling the receiver 608 to the discharge communicator 611.

The assembly counterpart 600C also includes a wellbore sealed interface effector 400 configured for interacting with a wellbore feature for defining a wellbore sealed interface 500 within the wellbore 102, between: (a) an uphole wellbore space 108 of the wellbore 102, and (b) a downhole wellbore space 110 of the wellbore 102, while the assembly 10 is disposed within the wellbore 102. The sealed interface 500 prevents, or substantially prevents reservoir fluid, that is being received by the reservoir fluid receiver 602, from bypassing the uphole wellbore space 108.

The disposition of the sealed interface 500 is such that flow communication, via the intermediate wellbore passage 112, between an uphole wellbore space 108 and a downhole wellbore space 110 (and across the sealed interface 500), is prevented, or substantially prevented. In some embodiments, for example, the disposition of the sealed interface 500 is such that fluid flow, across the sealed interface 500, in a downhole direction, from the uphole wellbore space 108 to the downhole wellbore space 110, is prevented, or substantially prevented.

In such embodiments, for example, the disposition of the sealed interface 500 is effected by the combination of at least: (i) a sealed, or substantially sealed, disposition of the wellbore string 113 relative to a polished bore receptacle 114 (such as that effected by a packer 240A disposed between the wellbore string 113 and the polished bore receptacle 114), and (ii) a sealed, or substantially sealed, disposition of the downhole production string portion 206 relative to the polished bore receptacle 114 such that reservoir fluid flow, that is received within the wellbore 102 (that is lined with the wellbore string 113), is prevented, or substantially prevented, from bypassing the reservoir fluid receiver 602, and, as a corollary, is directed to the reservoir fluid receiver 602 for receiving by the reservoir fluid receiver 602.

In some embodiments, for example, the sealed, or substantially sealed, disposition of the downhole fluid conductor 206 relative to the polished bore receptacle 114 is effected by a latch seal assembly. A suitable latch seal assembly is a Weatherford™ Thread-Latch Anchor Seal Assembly™.

In some embodiments, for example, the sealed, or substantially sealed, disposition of the downhole fluid conductor 206 relative to the polished bore receptacle 114 is effected by one or more o-rings or seal-type Chevron rings. In this respect, the sealing interface effector 400 includes the o-rings, or includes the seal-type Chevron rings.

In some embodiments, for example, the sealed, or substantially sealed, disposition of the downhole fluid conductor 206 relative to the polished bore receptacle 114 is disposed in an interference fit with the polished bore receptacle. In some of these embodiments, for example, the downhole fluid conductor 206 is landed or engaged or "stung" within the polished bore receptacle 114.

The above-described disposition of the wellbore sealed interface 500 provide for conditions which minimize solid debris accumulation in the joint between the downhole fluid conductor 206 and the polished bore receptacle 114 or in the joint between the polished bore receptacle 114 and the casing 113. By providing for conditions which minimize solid debris accumulation within the joint, interference to movement of the separator relative to the liner, or the casing, as the case may be, which could be effected by accumulated solid debris, is mitigated.

Referring to FIG. 2, in some embodiments, for example, the sealed interface 500 is disposed within a section of the wellbore 102 whose axis 14A is disposed at an angle "α" of at least 60 degrees relative to the vertical "V". In some of these embodiments, for example, the sealed interface 500 is disposed within a section of the wellbore whose axis is disposed at an angle "a" of at least 85 degrees relative to the vertical "V". In this respect, disposing the sealed interface 500 within a wellbore section having such wellbore inclinations minimizes solid debris accumulation at the sealed interface 500.

In some embodiments, for example, the flow diverter body 600A and the wellbore sealed interface effector 400 are co-operatively configured such that, while: (a) the assembly 10 is disposed within the wellbore 102 (such as, for example, within the wellbore string 113) and oriented such that the production string inlet 204 is disposed downhole relative to (such as, for example, vertically below) the production string outlet 208, and such that the wellbore sealed interface 500 is defined by interaction between the wellbore sealed interface effector 400 and a wellbore feature (such as, for example, a wellbore sealed interface 500 defined by sealing, or substantially sealing, disposition of the effector 400 relative to the wellbore string 113); and (b) displacement of the reservoir fluid from the subterranean formation is being effected by the pump 300 such that the reservoir fluid is being received by the inlet 204 (such as, for example, as a reservoir fluid flow) and conducted to the reservoir fluid discharge communicator 604 via the reservoir fluid receiver 602:

the reservoir fluid is discharged from the reservoir fluid discharge communicator 604 and into the uphole wellbore space 108, and, within the reservoir fluid separation space 112X, gaseous material is separated from the received reservoir fluid, in response to at least buoyancy forces, such that the gas-depleted reservoir fluid is obtained and is conducted to the gas-depleted reservoir fluid receiver 608, and the received gas-depleted reservoir fluid is conducted from the gas-depleted reservoir fluid receiver 608 to the pump 300 via at least the conductor 610 and the gas-depleted reservoir fluid discharge communicator 611.

In this respect, in such embodiments, for example, at least a portion of the space within the wellbore 102, between the reservoir fluid discharge communicator 604 and the gas-depleted reservoir fluid receiver 608, defines at least a portion of the gas-depleted reservoir fluid-conducting passage 6004.

Also, the separation of gaseous material from the reservoir fluid is with effect that a liquid-depleted reservoir fluid is obtained and is conducted uphole via the intermediate wellbore passage 112 that is disposed between the assembly 10 and the wellbore string 113 (see above).

Referring to FIG. 3, in some embodiments, for example, the reservoir fluid discharge communicator 604 is oriented such that, while the assembly 10 is disposed within the wellbore 102 and oriented such that the production string inlet 204 is disposed downhole relative to the production string outlet 208, a ray (see, for example ray 604A, which corresponds), that is disposed along the central longitudinal axis of the reservoir fluid discharge communicator, is disposed in an uphole direction at an acute angle of less than 30 degrees relative to the central longitudinal axis of the wellbore portion within which the flow diverter body 600A is disposed.

Again referring to FIG. 3, in some embodiments, for example, the reservoir fluid discharge communicator 604 is oriented such that, while the assembly 10 is disposed within the wellbore 102 and oriented such that the production string inlet 204 is disposed downhole relative to the production string outlet 208, a ray (see, for example ray 604A in FIG. 4), that is disposed along the central longitudinal axis of the reservoir fluid discharge communicator 604, is disposed in an uphole direction at an acute angle of less than 30 degrees relative to the vertical (which includes disposition of the ray 604A along a vertical axis).

The reservoir fluid produced from the subterranean formation 100, via the wellbore 102, including the gas-depleted reservoir fluid, the liquid-depleted reservoir material, or both, may be discharged through the wellhead 116 to a collection facility, such as a storage tank within a battery.

In some embodiments, for example, the flow diverter body 600A is integrated into the assembly such that, while the assembly 10 is disposed within the wellbore 102 and oriented such that the production string inlet 204 is disposed downhole relative to (such as, for example, vertically below) the production string outlet 208, the flow diverter body 600A is oriented such that the gas-depleted reservoir fluid receiver 608 is disposed downhole relative to (such as, for example, vertically below) the reservoir fluid discharge communicator 604. In this respect, in some embodiments, for example, the flow diverter body 600A and the sealed interface effector 400 are co-operatively configured such that, while: (a) the assembly 10 is disposed within the wellbore 102 (such as, for example, the wellbore string 113) and oriented such that the production string inlet 204 is disposed downhole relative to (such as, for example, vertically below) the production string outlet 208, and such that the wellbore sealed interface 500 is defined by interaction between the wellbore sealed interface effector 400 and a wellbore feature (such as, for example, a wellbore sealed interface 500 defined by sealing, or substantially sealing, disposition of the effector 400 relative to the wellbore string 113), and (d) displacement of the reservoir fluid from the subterranean formation is being effected such that the reservoir fluid is being received by the inlet 204 (such as, for example, as a reservoir fluid flow) and conducted to the reservoir fluid discharge communicator 604.

the reservoir fluid is discharged from the reservoir fluid discharge communicator 604 and into the uphole wellbore space 108, and, within a reservoir fluid separation space 112X, gaseous material is separated from the discharged reservoir fluid in response to at least buoyancy forces such that the gas-depleted reservoir fluid is obtained, and is conducted downhole to the gas-depleted reservoir fluid receiver 608, and the gas-depleted reservoir fluid, received by the gas-depleted reservoir fluid receiver 608, is conducted from the gas-depleted reservoir fluid receiver 608 to the pump 300 via at least the conductor 610 and the gas-depleted reservoir fluid discharge communicator 611.

In some embodiments, for example, separation of gaseous material, from the reservoir fluid that is discharged from the reservoir fluid discharge communicator 604, is effected within an uphole-disposed space 1121X of the intermediate wellbore passage 112, the uphole-disposed space 1121X being disposed uphole relative to the reservoir fluid discharge communicator 604. In this respect, in some embodiments, for example, the reservoir fluid separation space 112X includes the uphole-disposed space 1121X.

In some embodiments, for example, a flow diverter body-defined intermediate wellbore passage portion 1121Y of the intermediate wellbore passage 112 is disposed within a space between the flow diverter body 600A and the wellbore string 113, and effects flow communication between the reservoir fluid discharge communicator 604 and the gas-depleted reservoir fluid receiver 608 for effecting conducting of the gas-depleted reservoir fluid to the gas-depleted reservoir fluid receiver 608. In this respect, in such embodiments, for example, the flow diverter body-defined intermediate wellbore passage portion 1121Y defines at least a portion of the gas-depleted reservoir fluid-conducting passage 6004.

In some embodiments, for example, the space between the flow diverter body 600A and the wellbore string 113, within which the flow diverter body-defined intermediate wellbore passage portion 1121Y is disposed, is an annular space. In some embodiments, for example, the flow diverter body-defined intermediate space 1121Y is defined by the entirety, or the substantial entirety, of the space between the flow diverter body 600A and the wellbore string 113. In some embodiments, for example, separation of gaseous material, from the reservoir fluid that is discharged from the reservoir fluid discharge communicator 604, is effected within the flow diverter body-defined intermediate wellbore passage portion 1121Y. In this respect, in some embodiments, for example, the reservoir fluid separation space 112X includes the flow diverter body-defined intermediate wellbore passage portion 1121Y.

In some embodiments, for example, the separation of gaseous material, from the reservoir fluid that is being discharged from the reservoir fluid discharge communicator 604, is effected within both of the uphole-disposed space 1121X and the flow diverter body-defined intermediate wellbore passage portion 1121Y. In this respect, in some embodiments, for example, the reservoir fluid is discharged from the reservoir fluid discharge communicator 604 into the uphole wellbore space 1121X, and, in response to at least buoyancy forces, the gaseous material is separated from the discharged reservoir fluid, while the reservoir fluid is being conducted downhole, from the uphole-disposed space 1121X, through the flow diverter body-defined intermediate wellbore passage portion 1121Y, and to the gas-depleted reservoir fluid receiver 608.

In some embodiments, for example, the space, between: (a) the gas-depleted reservoir fluid receiver 608 of the flow diverter body 600A, and (b) the sealed interface 500, defines a sump 700 for collection of solid particulate that is entrained within fluid being discharged from the reservoir fluid outlet ports 606 of the flow diverter body 600A, and the sump 700 has a volume of at least 0.1 $m^3$. In some embodiments, for example, the volume is at least 0.5 $m^3$. In some embodiments, for example, the volume is at least 1.0 $m^3$. In some embodiments, for example, the volume is at least 3.0 $m^3$.

By providing for the sump 700 having the above-described volumetric space characteristic, and/or the above-described minimum separation distance characteristic, a suitable space is provided for collecting relative large volumes of solid debris, from the gas-depleted reservoir fluid being flowed downwardly to the gas-depleted reservoir fluid receiver 608, such that interference by the accumulated solid debris with the production of oil through the system is mitigated. This increases the run-time of the system before any maintenance is required. As well, because the solid debris is deposited over a larger area, the propensity for the collected solid debris to interfere with movement of the flow diverter body 600A within the wellbore 102, such as during maintenance (for example, a workover) is reduced.

As above-described, the uphole fluid conductor 210 extends from the gas-depleted reservoir fluid discharge communicator 611 to the wellhead 116 for effecting flow communication between the discharge communicator 611 and the earth's surface 106, such as, for example, a collection facility located at the earth's surface 106, and defines a fluid passage 210A. In some embodiments, for example, downhole fluid conductor 206 defines a fluid passage 206A. The cross-sectional flow area of the fluid passage 210A is greater than the cross-sectional flow area of the fluid passage 206A. In some embodiments, for example, the ratio of the cross-sectional flow area of the fluid passage 210A to the cross-sectional flow area of the fluid passage 206A is at least 1.1, such as, for example, at least 1.25, such as, for example, at least 1.5.

In some embodiments for example, if the available space within the wellbore fluid conductor, for conducting reservoir fluid, is sufficiently small, gaseous reservoir fluid being conducted upwardly to the surface may become disposed at a speed such that liquid hydrocarbon material remains entrained within the upwardly-flowing gaseous material, and liquid reservoir fluid being conducted downwardly may become disposed at such a speed such that gaseous material remains entrained within the downwardly-flowing liquid material. In these circumstances, separation of the liquid hydrocarbon material from the gaseous material is compromised. To mitigate such entrainment, and promote separation of the liquid hydrocarbon material from the reservoir fluid being discharged from the discharge communicator 604, the reservoir fluid separation space 112X, within which the separation is effected, is correspondingly configured.

In this respect, in one aspect, at least a portion of the reservoir fluid reservoir fluid separation space 112X, which defines a separation-facilitating passage portion 112A of the intermediate wellbore passage 112, is disposed within a wider intermediate section 113A of the wellbore string 113. In some embodiments, for example, the separation-facilitating portion 112A spans a continuous space 112Y that extends outwardly (such as, for example, laterally, or, for example, radially), relative to the central longitudinal axis 10X of the portion of the assembly 10 disposed within the wider intermediate section 113A, from the assembly 10 to the wider intermediate section 113A. In some embodiments, for example, the outward (such as, for example, lateral of, for example, radial) extension of the continuous space 112Y from the assembly 10 to the wider intermediate section 113A is relative to the central longitudinal axis 113AX of the wider intermediate section 113A. In some embodiments, for example, the outward (such as, for example, lateral of, for example, radial) extension of the continuous space 112Y from the assembly 10 to the wider intermediate section 113A is relative to the central longitudinal axis 102X of the wellbore 102. In some embodiments, for example, the continuous space 112Y defines a cross-sectional flow area of the separation-facilitating passage portion 112A. In some embodiments, for example, the ratio of the minimum cross-sectional flow area of the separation-facilitating passage portion 112A to the maximum cross-sectional flow area of the fluid passage 206A defined by the downhole fluid conductor 206 is at least about 1.5.

In another aspect, the separation-facilitating passage portion 112A is disposed within a wider intermediate section 113A of the wellbore string 113, and includes a cross-sectional flow area that extends from the assembly 10 to the wider intermediate section 113A.

Uphole relative to the wider intermediate section 113A, the wellbore string 113 includes an uphole-disposed section 113B. In this respect, the wider intermediate section 113A is disposed downhole relative to the uphole-disposed section 113B. As illustrated in FIGS. 1, 2, 5, and 6, in some embodiments, for example, the uphole-disposed section 113B is disposed immediately uphole relative to the wider intermediate section 113A. The uphole-disposed section includes a narrower uphole-disposed section 113BN. The wider intermediate section 113A is wider relative to a narrower uphole-disposed section 113BN and is also disposed downhole relative to the narrower uphole-disposed section 113BN. In some embodiments, for example, the wider intermediate section 113A defines a bulge 113X within the wellbore string 113.

Referring to FIGS. 1, 2, 5 and 6, in some embodiments, for example, the narrower uphole-disposed section 113BN extends to the wellhead. In some embodiments, for example, the narrower uphole-disposed section 113BN does not extend to the wellhead, and a wider uphole-disposed section 113BW is disposed uphole relative to the narrower uphole-disposed section 113BN, and, in some embodiments, is wider relative to the wider intermediate section 113A.

In some embodiments, for example, the ratio of: (a) the minimum width of the wider intermediate section 113A to (b) the maximum width of the narrower uphole-disposed section 113BN is at least about 1.1, such as, for example, at least about 1.15, such as, for example, at least about 1.2.

In some embodiments, for example, the wellbore string 113 defines an internal passage 1131, and a cross-sectional area of the internal passage 1131A of the wider intermediate section 113 is greater than a cross-sectional area of the internal passage 1131BN of the narrower uphole-disposed section 113BN. In some embodiments, for example, the ratio of: (a) a cross-sectional area of the internal passage 1131A of the wider intermediate section 113 to (b) a cross-sectional area of the internal passage 1131BN of the narrower uphole-disposed section 113BN is at least about 1.1, such as, for example, at least about 1.15, such as, for example, at least about 1.2.

In some embodiments, for example, the wider intermediate section 113A has a longitudinal axis 113AX, and the length of the wider intermediate section 113A, measured along its longitudinal axis 113AX, is at least about 40 feet, such as, for example, between about 40 feet and about 300 feet.

In some embodiments, for example, the ratio of: (a) the length of the narrower uphole-disposed section 113BN, measured along its longitudinal axis 113BNX to (b) the length of the wider intermediate section 113A, measured along its longitudinal axis 113AX is at least about two (2), such as, for example, at least about three (3).

Referring to FIG. 2, in some embodiments, for example, the separation-facilitating passage portion 112A is disposed between the flow diverter body 600A and the wellbore string 113, and, in this respect, is the flow diverter body-defined intermediate portion 1121Y of the intermediate wellbore passage 112. In some of these embodiments, for example, flow diverter body-defined intermediate portion 1121Y is defined by the entirety, or the substantial entirety, of the space between the flow diverter body 600A and the wellbore string 113.

Figure 5:
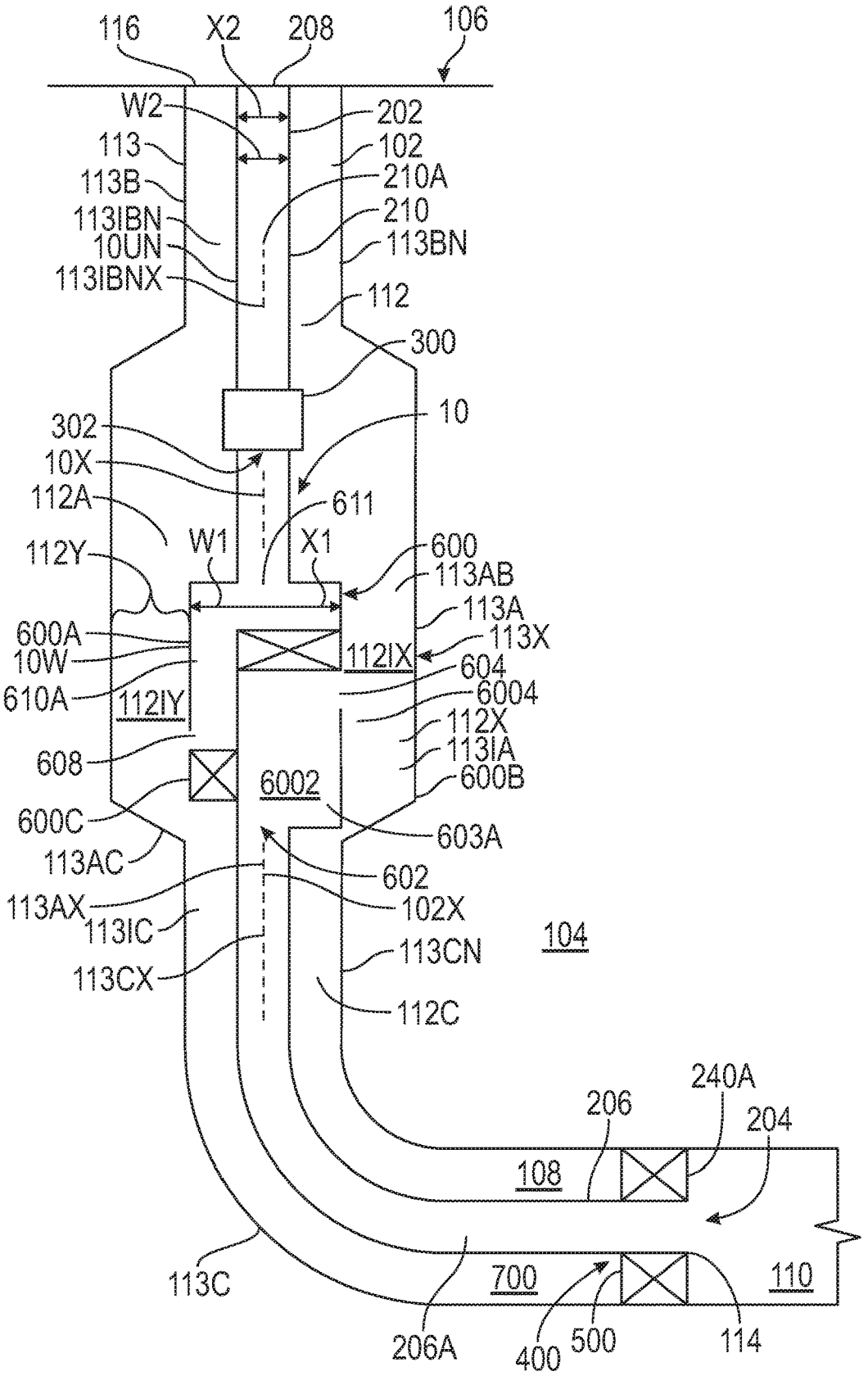
FIG. 5 is a schematic illustration of another embodiment of a system including a reservoir fluid production assembly disposed within a wellbore.
Figure 6:
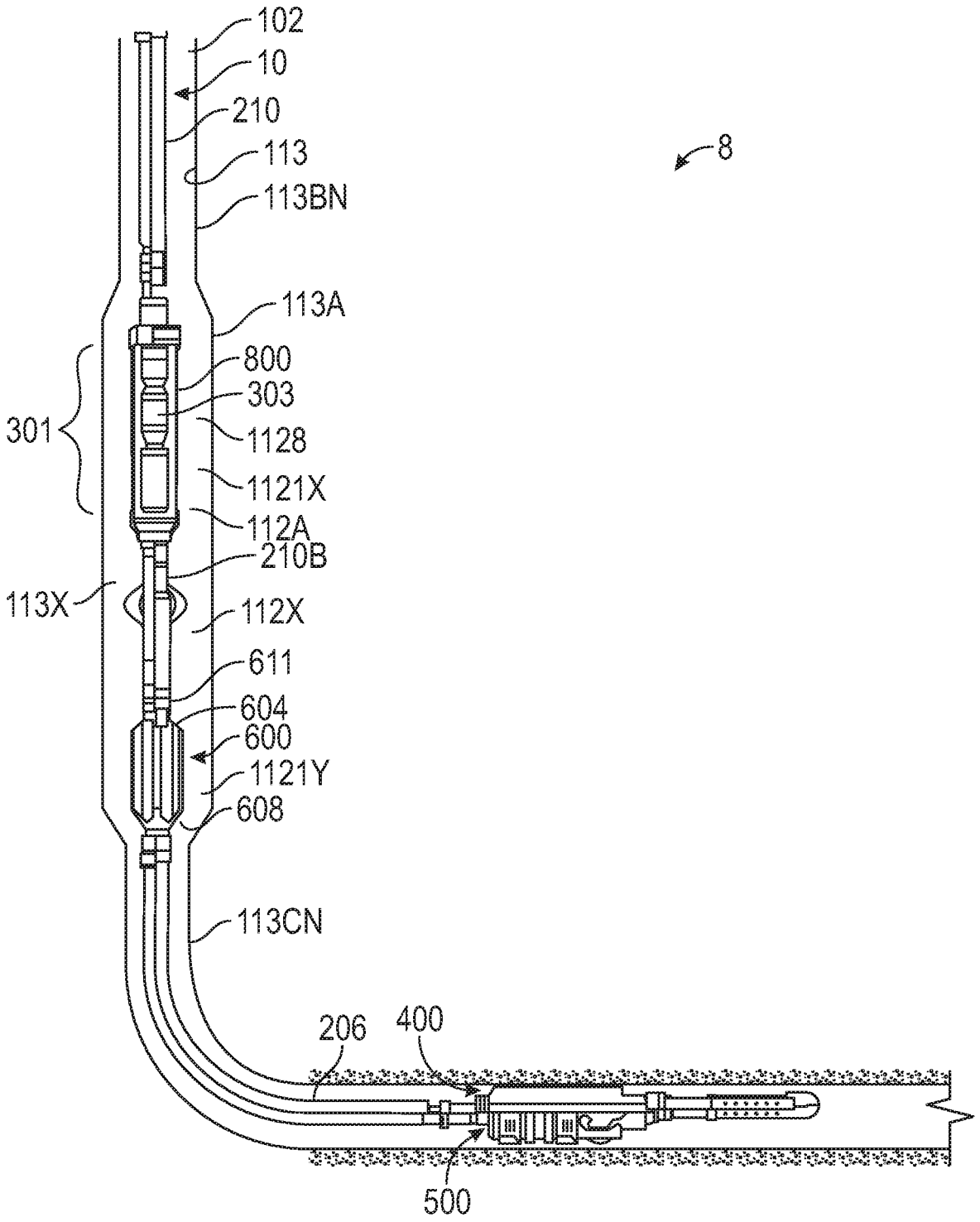
FIG. 6 is a schematic illustration of another embodiment of a system including a reservoir fluid production assembly disposed within a wellbore.

Referring to FIGS. 1, 5, and 6, in some embodiments, for example, the separation-facilitating passage portion 112A is disposed uphole relative to the reservoir fluid discharge communicator 604, such as, for example, within the uphole-disposed space 1121X.

Again referring to FIGS. 1, 5, and 6, in some embodiments, for example, the separation-facilitating passage portion 112A the separation-facilitating passage portion includes: (i) an uphole-disposed space 1121X, and (ii) the flow diverter body-defined intermediate portion 1121Y, and the uphole-disposed space 1121X is disposed uphole relative to the reservoir fluid discharge communicator 604. In some embodiments, for example, the flow diverter body-defined intermediate space 1121Y merges with the uphole-disposed space 1121X.

Figure 4:
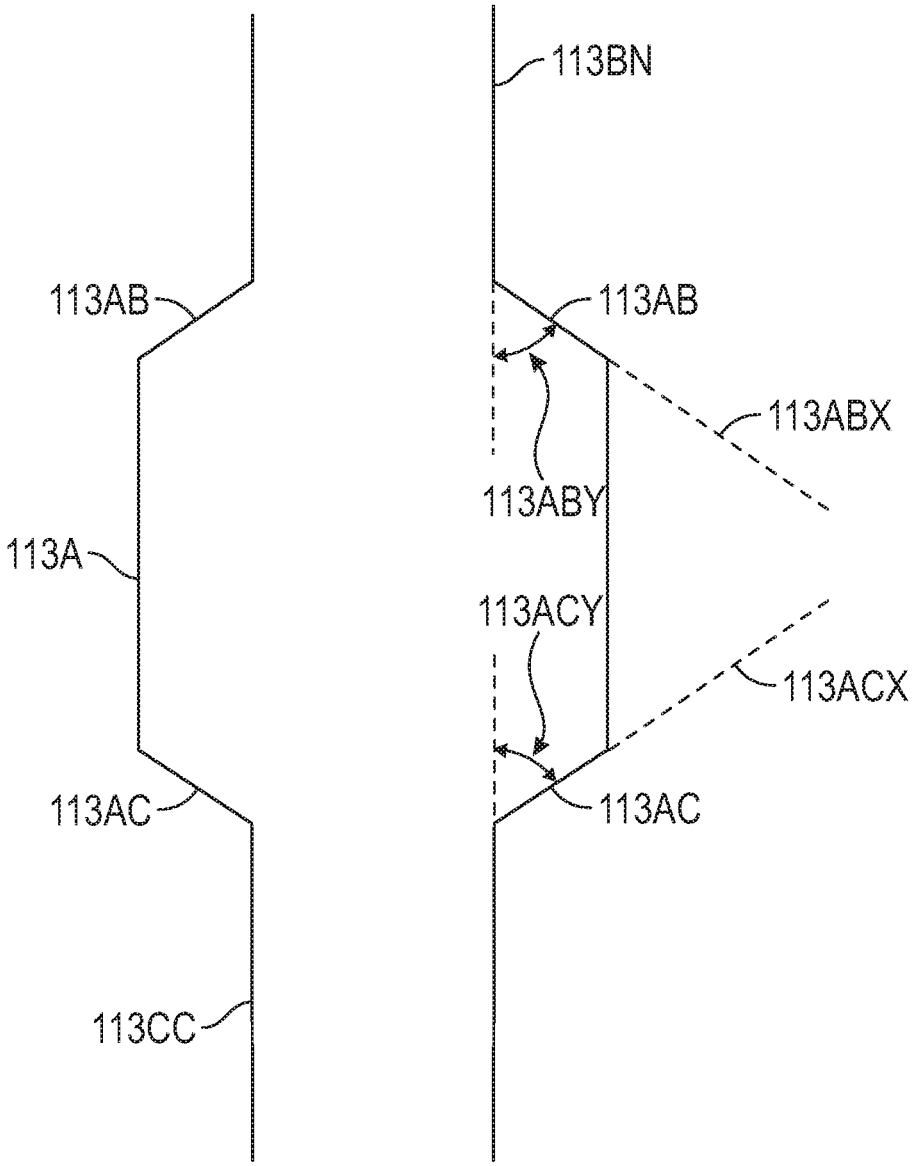
FIG. 4 is a schematic illustration of a wider intermediate section of the wellbore string of embodiments of the system of the present disclosure.

Referring to FIG. 4, in some embodiments, for example, the narrower uphole-disposed section 113BN merges with the wider intermediate section 113A via an uphole transition section 113AB of the wellbore string 113. In this respect, in some embodiments, for example, the wider intermediate section 113A necks down to the narrower uphole-disposed section 113BN via the transition section 113AB. The uphole transition section 113AB extends from the narrower uphole-disposed section 113BN along, or substantially along, an upper transition section axis 113ABX that is disposed at an acute angle 113ABY of less than about 45 degrees relative to a reference axis that is parallel, or substantially parallel, to a longitudinal axis 113AX of the wider intermediate section 113A. In some embodiments, for example, the acute angle 113ABY is less than about 35 degrees, such as, for example, less than about 25 degrees, such as, for example, less than about 20 degrees, such as, for example, less than about 10 degrees, such as, for example, less than about 7.5 degrees. In some embodiments, for example, the acute angle 113ABY is about 5 degrees. In some embodiments, for example, by configuring the uphole transition section 113AB in this manner, any one or more of the following is realized: solids accumulation is mitigated, erosion is mitigated, and guidance is provided for tool entry.

In some embodiments, for example, the separation-facilitating passage portion 112A includes a minimum cross-sectional area, and the ratio of: (a) the minimum cross-sectional area of the separation-facilitating passage portion 112A, to (b) a maximum cross-sectional area of the narrower uphole-disposed section-defined passage portion 112B of the intermediate wellbore passage 112 (the narrower uphole-disposed section-defined passage portion 112B being defined between the narrower uphole-disposed section 113BB and the assembly 10 and disposed in flow communication with the separation-facilitating passage portion 112A) is at least about 0.9, such as, for example, at least about 0.95, such as, for example, at least about 1.0, such as for example, at least about 1.05, such as, for example at least about 1.1.

In some embodiments, for example, downhole relative to the wider intermediate section 113A, the wellbore string 113 includes a downhole disposed section 113C. In this respect, the intermediate section 113A is disposed uphole relative to the downhole-disposed section 113C. The downhole-disposed section includes a narrower downhole-disposed section 113CC. In some embodiments, for example, the wider intermediate section 113A is wider relative to the narrower downhole-disposed section 113NC, and is disposed uphole relative to the narrower downhole-disposed section 113NC.

In some embodiments, for example, the ratio of: (a) the minimum width of the wider intermediate section 113A to (b) the maximum width of the narrower downhole-disposed section 113NC is at least about 1.1, such as, for example, at least 1.15, such as, for example, at least 1.2.

In some embodiments, for example, a cross-sectional area of the internal passage 1131A of the wider intermediate section 113A is greater than a cross-sectional area of the internal passage 1131C of the narrower downhole-disposed section 113NC. In some embodiments, for example, the ratio of: (a) a cross-sectional area of the internal passage 1131A of the wider intermediate section 113A to (b) a cross-sectional area of the internal passage 1131C of the narrower downhole-disposed section 1131CN is at least 1.15, such as, for example, at least 1.2, such as, for example, at least 1.25, such as, for example, at least about 1.3.

In some embodiments, for example, the narrower downhole-disposed section 113CC merges with the wider intermediate section 113A via a downhole transition section 113AC of the wellbore string 113. In this respect, in some embodiments, for example, the wider intermediate section 113A necks down to the narrower downhole-disposed section 113CC via the transition section 113AC. The downhole transition section 113AC extends from the narrower downhole-disposed section 113CC along, or substantially along, an upper transition section axis 113ACX that is disposed at an acute angle 113ACY of less than about 25 degrees relative to a reference axis that is parallel, or substantially parallel, to a longitudinal axis 113AX of the wider intermediate section 113A. In some embodiments, for example, the acute angle 113ACY is less than about 45 degrees. In some embodiments, for example, the acute angle 113ACY is less than about 35 degrees, such as, for example, less than about 25 degrees, such as, for example, less than about 20 degrees, such as, for example, less than about 10 degrees, such as, for example, less than about 7.5 degrees, such as, for example, less than about 5 degrees. In some embodiments, for example, by configuring the downhole transition section 113AC in this manner, any one or more of the following is realized: solids accumulation is mitigated, erosion is mitigated, and guidance is provided for tool entry.

In some embodiments, for example, the separation-facilitating passage portion 112A includes a minimum cross-sectional area, and the ratio of (a) the minimum cross-sectional area of the separation-facilitating passage portion 112A to (b) the maximum cross-sectional area of a narrower downhole-disposed section-defined passage portion 112C of the intermediate wellbore passage 112 (the narrower downhole-disposed section-defined passage portion 112C being defined between the narrower downhole-disposed section 113CC and the assembly 10 is at least about 0.9, such as, for example, at least about 0.95, such as, for example, at least about 1.0, such as for example, at least about 1.05, such as, for example at least about 1.1.

In some embodiments, for example, the ratio of: (a) the length of the narrower downhole-disposed section 113CC, measured along its longitudinal axis 113CX to (b) the length of the wider intermediate section 113A, measured along its longitudinal axis 113AX is at least about two (2), such as, for example, at least about three (3).

In some embodiments, for example, the width of every section (including each one of the wider intermediate section 113A, the narrower uphole-disposed section 113BN, and the narrower downhole-disposed section 113CN, independently) of the wellbore string 113 is measured along an axis that is normal to the longitudinal axis of the wellbore 102. In some embodiments, for example, the axis is radially disposed relative to the central longitudinal axis 102X of the wellbore 102.

Referring to FIG. 5, in some embodiments, for example, the pump 300 is disposed within the wider intermediate section 113A. In some embodiments, for example, the pump 300 is relatively large for enabling relatively high production rates, or to compensate for relatively low bottomhole pressures, or both.

In some embodiments, for example, a portion of the assembly 10 that is disposed within the wider intermediate section 113A of the wellbore string 113 is a wider intermediate assembly portion 10W, and the portion 10U of the assembly 10 that is disposed uphole relative to the wider assembly portion includes a portion 10UN that is the narrowest portion of the uphole-disposed assembly portion 10U. In some embodiments, for example, the ratio of the width W1 of the wider intermediate assembly portion 10W to the width W2 of the narrowest uphole-disposed assembly portion 10UN is at least 1.09, such, as for example at least about 1.1, such as, for example, at least about 1.15, such as, for example, at least about 1.2, such as, for example, at least about 1.25. In some embodiments, for example, the ratio of the cross-sectional area X1 of the wider intermediate assembly portion 10W to the cross-sectional area X2 of the narrowest uphole-disposed assembly portion 10UN is at least about 1.18, such, as for example at least about 1.2, such as, for example, at least about 1.25, such as, for example, at least about 1.3, such as, for example, at least about 1.35.

Referring to FIG. 6, in some embodiments, for example, the assembly 10 includes an accumulator 800 that is associated with the pump 300. In some embodiments, for example, the pump includes an electrical submersible pump ("ESP") 301, disposed within the accumulator 800, and having a pump intake 303 for receiving gas-depleted reservoir fluid that has accumulated within the accumulator 800 after having being discharged from the gas-depleted reservoir fluid discharge communicator 611. In this respect, the accumulator 800 is fluidly coupled to the discharge communicator 611 with a fluid conductor 210B, such as piping, for accumulating the gas-depleted reservoir fluid received from the discharge communicator 611, and the accumulated fluid is conducted to the ESP 301 via the pump intake 303 for pressurizing by the ESP 301 such that the gaseous-depleted reservoir fluid is conducted to the surface via uphole fluid conductor 210. In some embodiments, for example, the accumulator 800 occupies a relatively significant portion of the wellbore 102 such that, potentially, the portion 1128 of the intermediate wellbore passage 112, that is disposed between the accumulator 800 and the wellbore string 113, defines an unacceptably small cross-sectional flow area, unless suitably configured. The intermediate wellbore passage portion 1128 defines at least a portion of an uphole-disposed space 1121X (which, in turn, defines at least a portion of the separation-facilitating passage portion 112A) which is receiving the reservoir fluid being discharged from the reservoir fluid discharge communicator 604. As discussed above, if the cross-sectional flow area of the intermediate wellbore passage portion 1128 is sufficiently small, reservoir fluid, being discharged from the discharge communicator 604 into the intermediate wellbore passage portion 1128, may be conducted uphole at sufficient speed such that liquid hydrocarbon material is lifted by gaseous material and remains entrained within the gaseous material such that separation of the liquid hydrocarbon material from the gaseous material is compromised. In this respect, to promote separation of the liquid hydrocarbon material from the reservoir fluid being discharged from the reservoir fluid discharge communicator 604 and into the intermediate wellbore passage portion 1128, the accumulator 800 (and, as a necessary incident, the ESP pump 301) is disposed within the wider intermediate section 113A, such that the intermediate wellbore passage portion 1128, which, effectively, defines at least a portion of the separation-facilitating passage portion 112A (see above), is sufficiently large to promote the separation of the liquid hydrocarbon material from the gaseous material.

Figure 7:
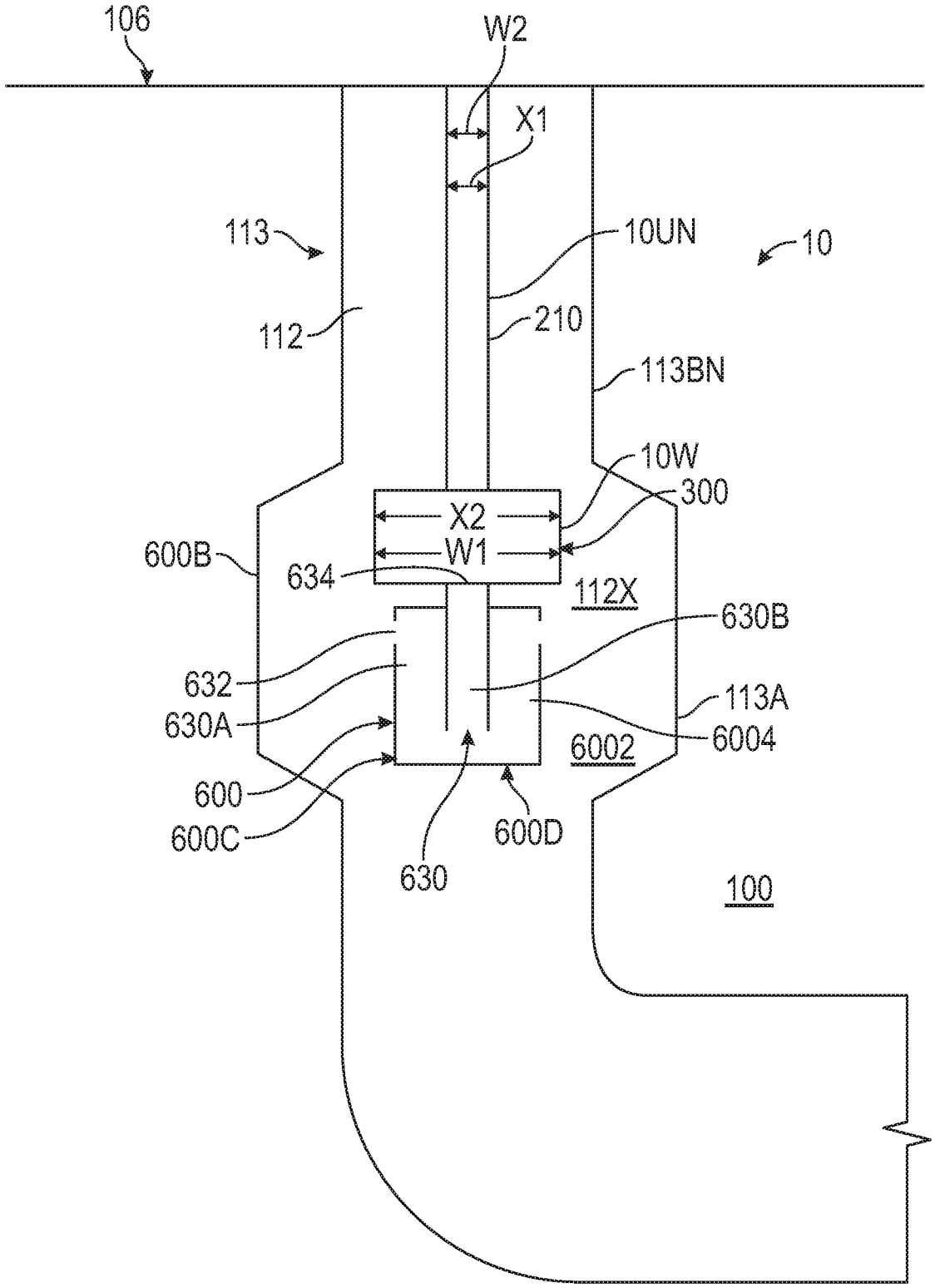
FIG. 7 is a schematic illustration of another embodiment of a system including a reservoir fluid production assembly disposed within a wellbore.

Referring to FIG. 7, in some embodiments, for example, the flow diverter 600 is configured in a form that is typically referred to as a "poor-boy gas separator". In such embodiments, for example, the assembly counterpart 600C defines the flow diverter body 600D, and the flow diverter body 600D includes a fluid passage 630 that defines at least a portion of the gas-depleted reservoir fluid-conducting passage 6004 for receiving the separated gas-depleted reservoir fluid while the separated gas-depleted reservoir fluid is flowing in a downhole direction, and diverting the flow of the received gas-depleted reservoir fluid such that the received gas-depleted reservoir fluid is conducted by the flow diverter body 600D in the uphole direction to the pump 300. The reservoir fluid, received within the wellbore string 113 from the subterranean formation 100 is conducted uphole, between the flow diverter body 600D and the wellbore string 113, within the reservoir fluid-conducting passage 6002. A gas-depleted reservoir fluid is separated from the reservoir fluid, in response to at least buoyancy forces, and is received by the gas-depleted reservoir fluid receiver 632 of the flow diverter body 600D, and is conducted in a downhole direction within the flow diverter body 600D via a downhole-conducting portion 630A of the fluid passage 630, and then diverted in an uphole direction for conduction in an uphole direction via the uphole-conducting portion 630B of the fluid passage 630. The gas-depleted reservoir fluid is discharged from the flow diverter body 630D via the discharge communicator 634 for supply to the pump 300.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A reservoir fluid production system for producing reservoir fluid from a subterranean formation, comprising:

a wellbore including an uphole portion and a downhole portion;

a wellbore string that is lining the wellbore;

wherein:

the wellbore string includes a wider intermediate section and an uphole-disposed section that is disposed uphole relative to the wider intermediate section;

the uphole-disposed section includes a narrower uphole-disposed section; and the wider intermediate section is wider relative to the narrower uphole-disposed section;

and a reservoir fluid production assembly disposed within wellbore string such that an intermediate wellbore passage is defined within a space between the wellbore string and the assembly and is extending longitudinally through the wellbore, wherein the assembly includes the wellbore string and the reservoir fluid production assembly are co-operatively configured such that, while the wellbore string is receiving reservoir fluid from the subterranean formation, the reservoir fluid is conducted uphole to a reservoir fluid separation space, with effect that a gas-depleted reservoir fluid is separated from the reservoir fluid within the reservoir fluid separation space and conducted through the reservoir fluid production assembly to the surface; and at least a portion of the reservoir fluid separation space defines a separation-facilitating passage portion of the intermediate wellbore passage, and the separation-facilitating passage portion is disposed within the wider intermediate section.

2. The system as claimed in claim 1;

wherein the assembly further includes a pump, and the pump is disposed within the wider intermediate section.

3. The system as claimed in claim 2;

wherein:

the assembly further includes a flow diverter that includes a string counterpart and an assembly counterpart, and defines: (i) a reservoir fluid-conducting passage for conducting reservoir fluid to the reservoir fluid separation space of the wellbore, with effect that a gas-depleted reservoir fluid is separated from the reservoir fluid within the reservoir fluid separation space in response to at least buoyancy forces; and (ii) a gas-depleted reservoir fluid-conducting passage for receiving the separated gas-depleted reservoir fluid while the separated gas-depleted reservoir fluid is flowing in a downhole direction, and diverting the flow of the received gas-depleted reservoir fluid such that the received gas-depleted reservoir fluid is conducted by the flow diverter in the uphole direction for discharge via a discharge communicator;

the wellbore string defines the string counterpart;

the reservoir fluid production assembly defines the assembly counterpart; and the discharge communicator of the flow diverter is fluidly coupled to the pump such that the flow diverter is disposed for supplying the pump with the gas-depleted reservoir fluid.

4. The system as claimed in claim 1;

wherein:

the assembly further includes a flow diverter that includes a string counterpart and an assembly counterpart, and defines: (i) a reservoir fluid-conducting passage for conducting reservoir fluid to the reservoir fluid separation space of the wellbore, with effect that a gas-depleted reservoir fluid is separated from the reservoir fluid within the reservoir fluid separation space in response to at least buoyancy forces; and (ii) a gas-depleted reservoir fluid-conducting passage for receiving the separated gas-depleted reservoir fluid while the separated gas-depleted reservoir fluid is flowing in a downhole direction, and diverting the flow of the received gas-depleted reservoir fluid such that the received gas-depleted reservoir fluid is conducted by the flow diverter in the uphole direction;

the wellbore string defines the string counterpart; and the reservoir fluid production assembly defines the assembly counterpart.

5. A reservoir fluid production system for producing reservoir fluid from a subterranean formation, comprising:

a wellbore including an uphole portion and a downhole portion;

a wellbore string that is lining the wellbore;

wherein:

the wellbore string includes a wider intermediate section and an uphole-disposed section that is disposed uphole relative to the wider intermediate section;

the uphole-disposed section includes a narrower uphole-disposed section; and the wider intermediate section is wider relative to the narrower uphole-disposed section;

a reservoir fluid production assembly disposed within wellbore string such that an intermediate wellbore passage is defined within a space between the wellbore string and the assembly and is extending longitudinally through the wellbore, wherein the assembly includes a flow diverter body including a reservoir fluid receiver, a reservoir fluid discharge communicator, and a gas-depleted reservoir fluid receiver;

and a sealed interface;

wherein:

the sealed interface prevents, or substantially prevents, flow communication, via the intermediate wellbore passage, between a downhole wellbore space and an uphole wellbore space;

the wellbore string, the assembly, and the sealed interface are co-operatively configured such that, while the flow diverter body is receiving reservoir fluid, via the reservoir fluid receiver, from the subterranean formation via the downhole wellbore space, and discharging the received reservoir fluid, via the reservoir fluid discharge communicator, into the uphole wellbore space, within a reservoir fluid separation space of the uphole wellbore space, a gas-depleted reservoir fluid is separated from the discharged reservoir fluid, in response to at least buoyancy forces, and is conducted to the gas-depleted reservoir fluid receiver;

and at least a portion of the reservoir fluid separation space defines a separation-facilitating passage portion of the intermediate wellbore passage, and the separation-facilitating passage portion is disposed within the wider intermediate section.

6. The system as claimed in claim 5;

wherein:

the assembly further includes:

a pump; and an uphole fluid conductor;

wherein:

the pump is fluidly coupled to the flow diverter body for receiving and pressurizing the gas-depleted reservoir fluid; and the uphole fluid conductor is for conducting the pressurized gas-depleted reservoir fluid to the surface;

and the flow diverter body includes:

a reservoir fluid conductor that is effecting flow communication between the reservoir fluid receiver and the reservoir fluid discharge communicator, a gas-depleted reservoir fluid conductor; and a gas-depleted reservoir fluid discharge communicator;

wherein:

the gas-depleted reservoir fluid conductor is effecting flow communication between the gas-depleted reservoir fluid receiver and the gas-depleted reservoir fluid discharge communicator; and the gas-depleted reservoir fluid discharge communicator is for supplying the pump with the received gas-depleted reservoir fluid.

7. The system as claimed in claim 6;

wherein the pump is disposed within the wider intermediate section.

8. The system as claimed in claim 5;

wherein the separation-facilitating passage portion is disposed between the flow diverter body and the wider intermediate section.

9. The system as claimed in claim 5;

wherein the separation-facilitating passage portion is disposed within an annulus that is defined between the flow diverter body and the wider intermediate section.

10. The system as claimed in claim 5;

wherein:

the separation-facilitating passage portion includes: (i) an uphole-disposed space, and (ii) a flow diverter body-defined intermediate space;

the uphole-disposed space is disposed uphole relative to the reservoir fluid discharge communicator; and the flow diverter body-defined intermediate space is disposed within an annulus that is defined between the flow diverter body and the wider intermediate section.

11. The system as claimed in claim 10;

wherein the flow diverter body-defined intermediate space merges with the uphole-disposed space.

12. The system as claimed in claim 5;

wherein the separation-facilitating passage portion spans a continuous space extending from the assembly to the wider intermediate section.

13. The system as claimed in claim 12;

wherein the continuous space extends outwardly relative to the central longitudinal axis of the assembly.

14. The system as claimed in claim 13;

wherein the continuous space extends outwardly relative to the central longitudinal axis of the wellbore.

15. The system as claimed in claim 5;

wherein:

the narrower uphole-disposed section merges with the wider intermediate section via an uphole transition section of the wellbore string; and the uphole transition section extends from the narrower uphole-disposed section along, or substantially along, an upper transition wellbore string section axis that is disposed at an acute angle of less than 45 degrees plus or minus 10% relative to a reference axis that is parallel, or substantially parallel, to the central longitudinal axis of the wellbore.

16. The system as claimed in claim 5;

wherein:

the ratio of: (a) the minimum width of the wider intermediate section to (b) the maximum width of the narrower uphole-disposed section is at least 1.1 plus or minus 10%.

17. The system as claimed in claim 5;

wherein:

the wellbore string defines an internal passage; and a cross-sectional area of the internal passage of the wider intermediate section is greater than a cross-sectional area of the internal passage of the narrower uphole-disposed section.

18. The system as claimed in claim 5;

wherein:

the ratio of: (a) a cross-sectional area of the internal passage of the wider intermediate section to (b) a cross-sectional area of the internal passage of the narrower uphole-disposed section is at least 1.15 plus or minus 10%.

19. The system as claimed in claim 5;

wherein:

the separation-facilitating passage portion includes a minimum cross-sectional area, and the ratio of: (a) the minimum cross-sectional area of the separation-facilitating passage portion, to (b) the maximum cross-sectional area of a narrower uphole-disposed section-defined passage portion of the intermediate wellbore passage, the narrower uphole-disposed section-defined passage portion being defined between the narrower uphole-disposed section and the assembly and disposed in flow communication with the separation-facilitating passage portion, is at least 0.9 plus or minus 10%.

20. The system as claimed in claim 5;

wherein:

the ratio of: (a) the length of the narrower uphole-disposed section, measured along its longitudinal axis to (b) the length of the wider intermediate section, measured along its longitudinal axis is at least two (2) plus or minus 10%.

* * * * *